US007319375B2

(12) United States Patent
Roy

(10) Patent No.: US 7,319,375 B2
(45) Date of Patent: Jan. 15, 2008

(54) UNIVERSAL BENCH MAGNET

(76) Inventor: Claude Roy, 7098 HWY 17, Hagar, Ontario (CA) P0M 1X0

( * ) Notice: Subject to any disclaimer, the term of this patent is extended or adjusted under 35 U.S.C. 154(b) by 0 days.

(21) Appl. No.: 11/004,735

(22) Filed: Dec. 6, 2004

(65) Prior Publication Data

US 2006/0119458 A1 Jun. 8, 2006

(51) Int. Cl.
*H01F 7/20* (2006.01)

(52) U.S. Cl. ..... 335/285; 335/290; 269/8

(58) Field of Classification Search ..... 335/285, 335/290; 269/8

See application file for complete search history.

(56) References Cited

U.S. PATENT DOCUMENTS 2,381,458 A * 8/1945 Meister ..... 86/1.1
2,992,580 A * 7/1961 Stolk et al. ..... 83/136
3,572,680 A * 3/1971 Neff ..... 269/8
4,684,112 A * 8/1987 Chernikov et al. ..... 269/8
4,777,463 A * 10/1988 Cory et al. ..... 335/289
2004/0145437 A1* 7/2004 Lee ..... 336/55

* cited by examiner

*Primary Examiner*—Elvin Enad
*Assistant Examiner*—Bernard Rojas

(57) ABSTRACT

An improve material holding device using magnetic force of variable strength comprising: an electromagnet mounted to a universal bracket adapted to mount to a vertical or horizontal surface, or a vise using the vise bar integrally attached to the underside of the magnet, a safety foot switch and timer, and control means to vary the force of said electromagnet. User can now safely free his hands from work pieces and speedily reposition said work piece.

8 Claims, 3 Drawing Sheets

UNIVERSAL BENCH MAGNET

FIELD OF THE INVENTION

The present invention relates to a material holding device using magnetic force of variable strength. The universal bench magnet comprises: an electromagnet mounted to a universal bracket adapted to mount to a vertical or horizontal surface, or a vise using the vise bar integrally attached to the underside of the magnet, a foot switch and timer, and control means to vary the force of said electromagnet. User can now free his hands from work pieces and speedily reposition said work piece.

BACKGROUND OF THE INVENTION

Particularly in the welding trade, steel and other materials of magnetic attraction are most commonly used. Oftentimes, smaller pieces are difficult to hold in position so as to perform welding, cutting and grinding thereon. Clamps as well as large permanent magnets are commonly used to fix the pieces in place, and as of late, electromagnets are also being used to provide more ease of use. Additionally, users tend to simply hold work pieces with one hand and the tool in the other hand, creating a potentially dangerous situation. Unfortunately, electromagnets of this magnitude may become overheated if left active for a prolonged length of time. Furthermore current work magnets are of single strength and usually form part of a complete work surface.

It became apparent to the inventor of the present invention to devise an universal bench magnet incorporating the valuable functions of magnetism, while providing overheat-protection means, a safer work piece holding means as well the liberty to mount the bench magnet of the present invention to virtually any bench, or even a vise.

While electromagnets have been used as a holding means in the past, prior art teaches of no such apparatus that provides user with all the benefits of the present invention.

SUMMARY OF THE INVENTION

It is thus the object of the present invention to provide users with an universal bench magnet incorporating the valuable functions of adjustable magnetism, while providing overheat-safety means, a safer work piece holding means as well as the liberty to mount the bench magnet of the present invention to virtually any bench, or even a vise.

In one aspect of the invention, the size of the bench magnet may be adapted to suit various industries.

In another aspect of the invention, the overheat-protection device may be that of either a timer or a heat sensor.

Accordingly, the universal bench magnet of the present invention allows users to safely free their hands from accurately holding work pieces, allow repositioning of said work pieces more speedily, adjust the magnetic force all while protecting said bench magnet from overheating.

BRIEF DESCRIPTION OF THE DRAWINGS

These and other advantages of the invention will become apparent upon reading the following brief description and upon referring to the drawings in which.

Figure 1:
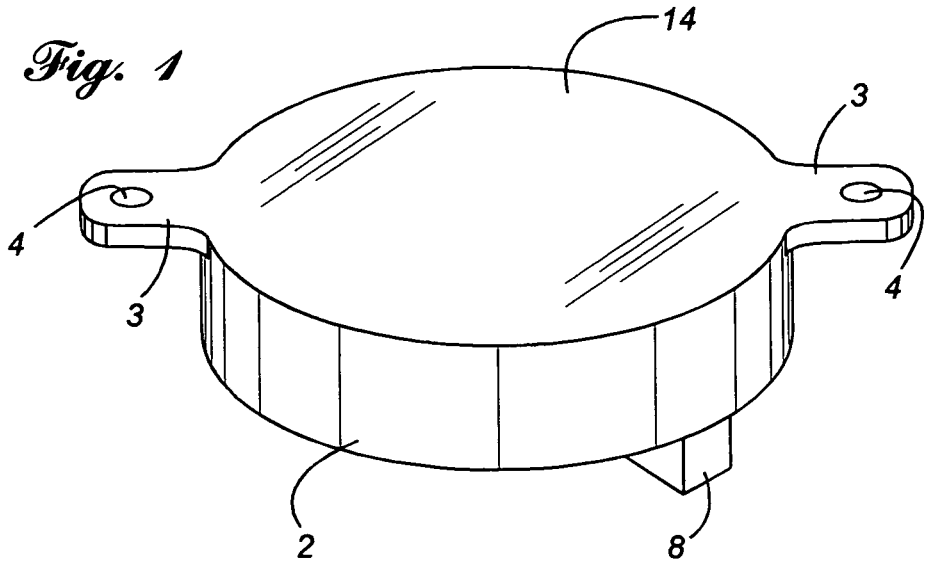
FIG. 1 is a perspective view from above of the universal bench magnet of the present invention.

While the invention is described in conjunction with preferred illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to the drawings, in particular, FIG. 1, a perspective view from above of the electromagnet portion of the universal bench magnet of the present invention comprising: a housing 2 generally cylindrically shaped, a wound coil within said housing, mounting tabs 3 having perforations 4 therethrough and integral with the upper surface 14 of the housing 2, an inner coil coolant material, overheat protection means, and a vise clamping bar 8 fixedly attached to the bottom portion of the housing 2 and spanning generally equally to the diameter of the housing 2.

Figure 2:
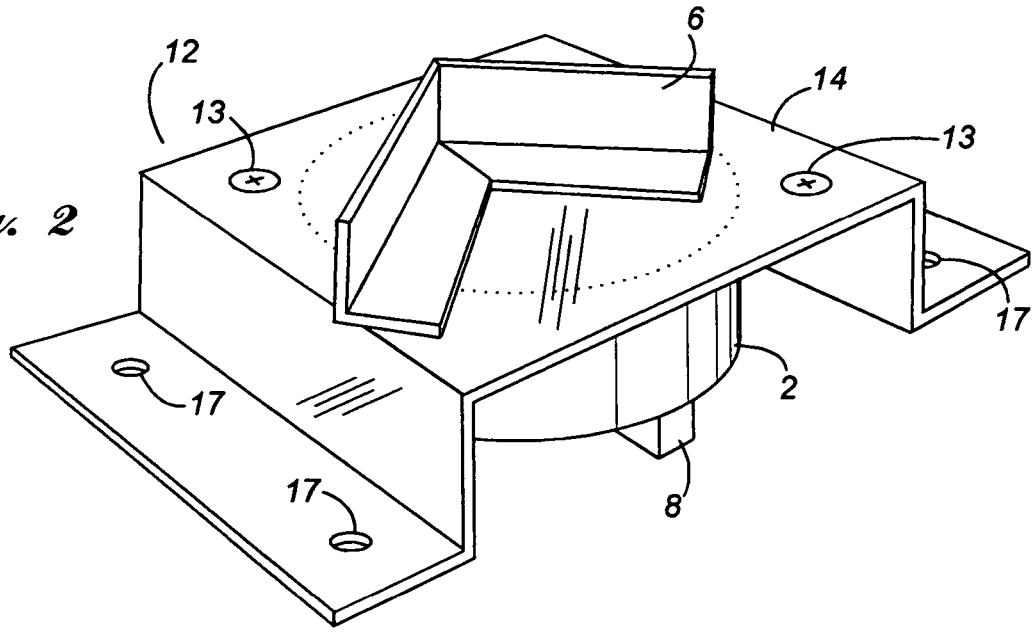
FIG. 2 is a perspective view from above of the universal bench magnet of the present invention shown holding a work piece.

Now turning to FIG. 2, which illustrates a perspective view of the assembly of the universal bench magnet of the present invention comprising; an electromagnet portion having a housing 2, a wound coil within said housing, mounting tabs, an inner coil coolant, overheat protection means, and a vise clamping bar 8, a universal mounting bracket 12 comprising: an electromagnet-attaching portion 14, and a bench attaching portion 16 having a plurality of perforations 17 therethrough to provide attaching means to a flat surface, a control system comprising: a power supply, an AC-DC transformer and rectifier, a current fuse, a timer, a heat sensor, an activating switch, and a power selector switch. When the foot-switch is closed, enabling the electromagnet, a work piece 6 can be held in a desired position then easily released by opening said foot-switch.

Figure 3:
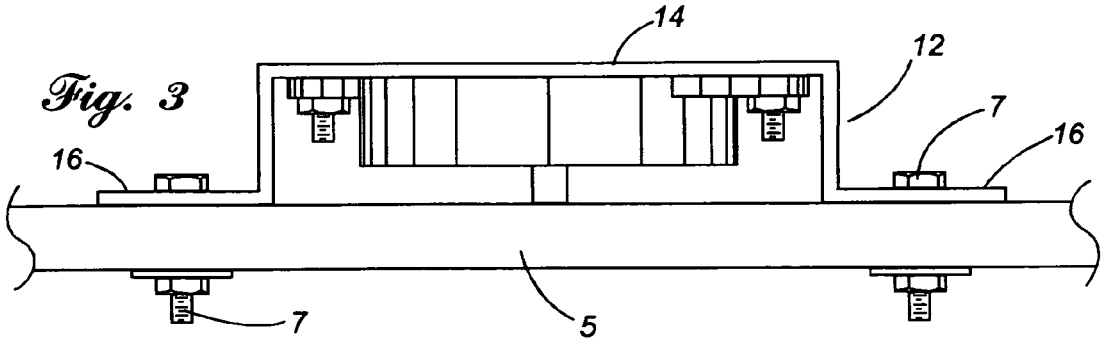
FIG. 3 is a front elevation view of the universal bench magnet of the present invention shown mounted onto a planar surface.

Turning now to FIG. 3, a front elevation view of the universal bench magnet of the present invention as showed mounted onto a flat surface 5 using the universal mounting bracket 12. The universal mounting bracket 12 comprises: a top planar electromagnet-holding portion 14 generally larger than the mating electromagnet, two vertically and downwardly protruding side members extending equally or below the height of said electromagnet, and horizontal mounting flanges 16 extending from the lower portion of the vertical side members so as to provide bench connecting means.

Figure 4:
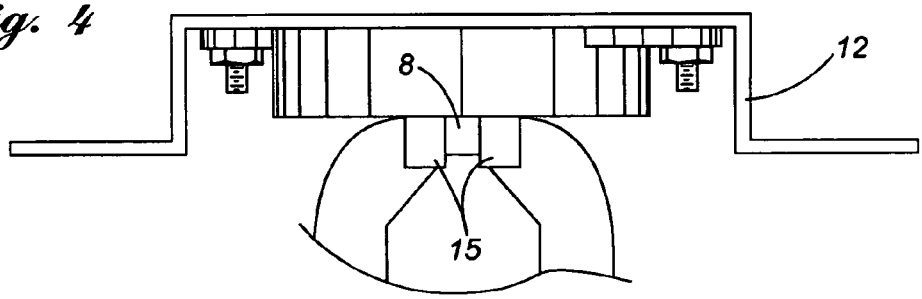
FIG. 4 is a front elevation view of an alternative mounting of the universal bench magnet of the present invention shown clamped into a conventional vise.

Turning to FIG. 4, further illustrating a front elevation view of the universal bench magnet of the present invention as shown mounted to a conventional bench vise using the vise-clamping bar 8 pressuredly inserted between vise jaws.

Figure 5:
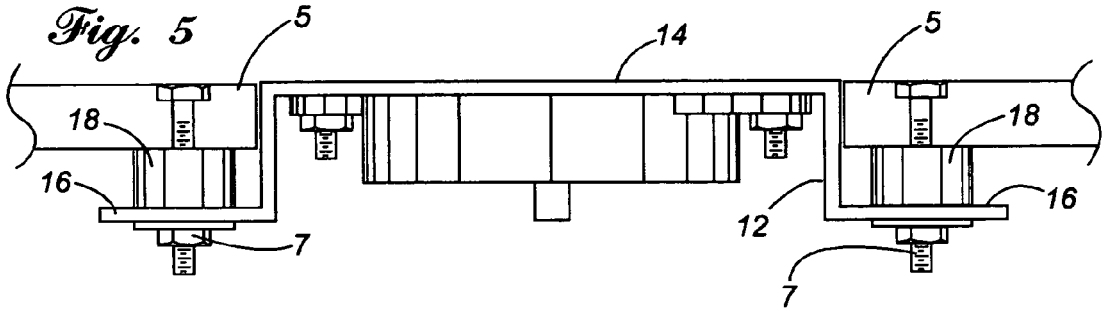
FIG. 5 is a front elevation view of an alternative mounting of the universal bench magnet of the present invention shown flush-mounted under a planar surface.

Turning now to FIG. 5, illustrating a front elevation view of the universal bench magnet of the present invention showing an alternative mounting method of said universal bench magnet wherein the uppermost surface of the mounting bracket 12 is flush with the upper surface of the bench 5.

Figure 6:
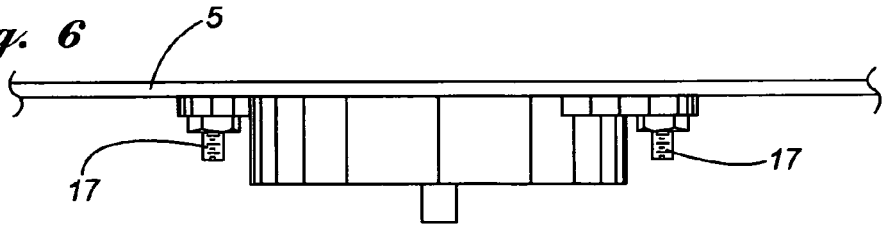
FIG. 6 is a front elevation view of an alternative mounting of the universal bench magnet of the present invention shown mounted under a thin planar surface.

Turning to FIG. 6, a front elevation view of the universal bench magnet without the universal mounting bracket wherein the electromagnet portion is securedly attached to the underside of a planar surface such as a steel work bench 5 via two recessed bolts 17.

Figure 7:
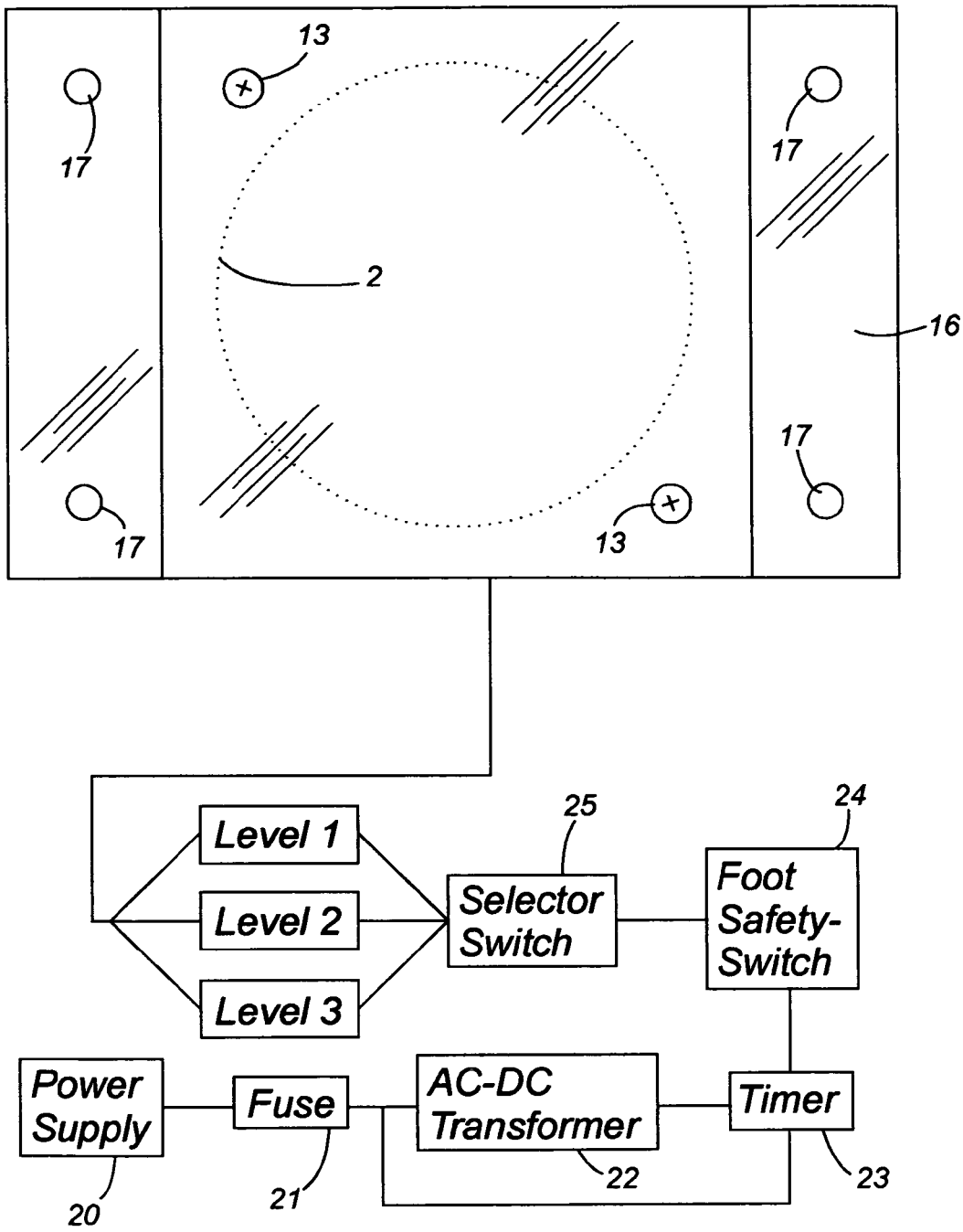
FIG. 7 is a top plan view of the universal bench magnet of the present invention along with a brief schematic of the key operative components of the device.

Turning to FIG. 7, a top plan view of the universal bench magnet of the present invention along with a brief schematic of the key operative components of the device wherein the electromagnet, mounted either to a bench surface using the universal mounting bracket 12 with bolts, or clamped into a vise jaw using the vise clamping bar, is powered and controlled by means of the following: household AC power outlets 20 feed a control panel adapted with a fuse 21 then transformed from AC to DC using a transformer and rectifier 22. A timer 23 is activated once the magnet is activated in the event the user forgets to turn the unit off. A selector switch 25 allows the user to select the magnetic force exerted by the magnet so as to allow easier placement of work piece prior to full-force holding. A foot switch 24 safely frees the user's hands to activate the bench magnet and perform work using both hands on the tool.

The invention claimed is:

1. An universal bench magnet comprising:

a. an electromagnet portion having,
   i. a housing,
   ii. a wound coil within said housing,
   iii. perforated mounting tabs,
   iv. an inner coil coolant,
   v. over heat protection means, and
   vi. a square vise-clamping bar, b. a universal mounting bracket:
   i. an electromagnet housing-attaching portion, and
   ii. a bench attaching portion c. a control system:
   i. a power supply,
   ii. an AC-DC transformer and rectifier,
   iii. a current fuse,
   iv. a timer,
   v. a heat sensor,
   vi. an activating switch,
   vii. a power selector switch, and d. a foot safety switch.

2. The universal bench magnet of claim 1 wherein the wound coil comprises a single insulated copper stand, which when energized, creates an electromagnetic field within a close parameter to said coil.

3. The universal bench magnet of claim 1 wherein the inner coil coolant comprises a liquid substance in direct contact with the insulated coil.

4. The universal bench magnet of claim 1 wherein the overheat protection means comprises a heat sensor.

5. The universal bench magnet of claim 1 wherein the vise clamping bar is a square bar fixedly attached to the central region at the underside of the electromagnet housing.

6. The universal bench magnet of claim 1 wherein the activation switch is connected in series with the foot actuator switch.

7. The universal bench magnet of claim 1 wherein the power selector comprises power settings selectable from: low, medium, high.

8. The universal bench magnet of either claims 1 through 7 wherein the use thereof is to allow users to free their hands from accurately and safely holding work pieces while allowing repositioning of said work pieces more speedily and adjust the magnetic force all while protecting said bench magnet from overheating.

* * * * *